US010260509B2

(12) United States Patent
Sakaguchi et al.

(10) Patent No.: US 10,260,509 B2
(45) Date of Patent: Apr. 16, 2019

(54) VACUUM PUMP

(71) Applicant: Edwards Japan Limited, Yachiyo-shi, Chiba (JP)

(72) Inventors: Yoshiyuki Sakaguchi, Yachiyo (JP); Tooru Miwata, Yachiyo (JP); Keita Mitsuhashi, Yachiyo (JP)

(73) Assignee: Edwards Japan Limited, Chiba (JP)

( * ) Notice: Subject to any disclaimer, the term of this patent is extended or adjusted under 35 U.S.C. 154(b) by 552 days.

(21) Appl. No.: 14/899,917

(22) PCT Filed: Jun. 6, 2014

(86) PCT No.: PCT/JP2014/065156
§ 371 (c)(1),
(2) Date: Dec. 18, 2015

(87) PCT Pub. No.: WO2015/001911
PCT Pub. Date: Jan. 8, 2015

(65) Prior Publication Data

US 2016/0138602 A1 May 19, 2016

(30) Foreign Application Priority Data

Jul. 5, 2013 (JP) ..... 2013-141863

(51) Int. Cl.
*F04D 19/04* (2006.01)
*F04D 29/28* (2006.01)
(Continued)

(52) U.S. Cl.
CPC ..... *F04D 19/04* (2013.01); *F04D 19/044* (2013.01); *F04D 29/28* (2013.01); *F04D 29/32* (2013.01);
(Continued)

(58) Field of Classification Search
CPC ..... F04D 19/04; F04D 19/042; F04D 19/044; F04D 19/046; F04D 17/168; F04D 29/526; F04D 29/541
See application file for complete search history.

(56) References Cited

U.S. PATENT DOCUMENTS 6,514,035 B2 * 2/2003 Iwane ..... F04D 19/044 415/143

FOREIGN PATENT DOCUMENTS

CN 102667169 A * 9/2012 ..... F04D 19/044
CN 202531443 U 11/2012
(Continued)

OTHER PUBLICATIONS

PCT International Search Report dated Aug. 19, 2014 for corresponding PCT Application No. PCT/JP2014/065156.
(Continued)

*Primary Examiner* — Ninh H. Nguyen
*Assistant Examiner* — Brian P Wolcott
(74) *Attorney, Agent, or Firm* — Westman, Champlin & Koehler, P.A.; Theodore M. Magee

(57) ABSTRACT

A vacuum pump is provided, which suppresses occurrence of a gas product in an exhaust side outlet of a thread groove and maintains pump performance over a long period. The vacuum pump includes inflow suppressing walls formed by widening greater an exhaust side end portion of ridge portions, extended along a gas exhaust direction on an outer circumferential surface of an inner circumference side stator, forward in a rotor rotating direction than an intake side end portion, the inflow suppressing walls suppressing retention of gas in exhaust side outlets of thread grooves engraved among the ridge portions.

7 Claims, 8 Drawing Sheets

(51) Int. Cl.

| | |
|---|---|
| ***F04D 29/32*** | (2006.01) |
| ***F04D 29/54*** | (2006.01) |
| *F04D 17/16* | (2006.01) |
| *F04D 29/44* | (2006.01) |

(52) U.S. Cl.
CPC ..... *F04D 29/324* (2013.01); *F04D 29/542* (2013.01); *F04D 29/544* (2013.01); *F04D 17/168* (2013.01); *F04D 29/444* (2013.01); *F05D 2240/122* (2013.01); *F05D 2240/304* (2013.01); *F05D 2250/70* (2013.01); *F05D 2260/607* (2013.01)

(56) References Cited

FOREIGN PATENT DOCUMENTS

| | | | |
|---|---|---|---|
| JP | H02107788 | U | 8/1990 |
| JP | H03168388 | A | 7/1991 |
| JP | H0538389 | | 5/1993 |
| JP | H0542695 | U | 6/1993 |
| JP | 3026217 | B1 | 3/2000 |
| JP | 2002349464 | A | 12/2002 |
| JP | 2003172289 | A | 6/2003 |
| JP | 2005105875 | A | 4/2005 |
| WO | 2011/070856 | A1 | 6/2011 |

OTHER PUBLICATIONS

Communication dated Feb. 13, 2017 and Supplementary European Search Report dated Feb. 2, 2017 for corresponding European Application No. EP14820682.

* cited by examiner

VACUUM PUMP

CROSS-REFERENCE TO RELATED APPLICATION

This Application is a Section 371 National Stage Application of International Application No. PCT/JP2014/065156, filed Jun. 6, 2014, which is incorporated by reference in its entirety and published as WO2015/001911 on Jan. 8, 2015 and which claims priority of Japanese Application No. 2013-141863, filed Jul. 5, 2013.

FIELD OF THE INVENTION

The present invention relates to a vacuum pump and, more particularly, to a vacuum pump usable in a pressure range from a medium vacuum to an ultra-high vacuum.

BACKGROUND OF THE INVENTION

When a semiconductor device such as a memory or an integrated circuit is manufactured, in order to avoid the influence due to dust and the like in the air, it is necessary to apply doping and etching to a high-purity semiconductor substrate (wafer) in a chamber in a high vacuum state. A vacuum pump such as a turbo molecular pump is used for exhaust in the chamber.

As such a vacuum pump, there is known a vacuum pump including a thread groove pump mechanism configured by a rotor including an outer cylinder rotor and an inner cylinder rotor, a stator including an outer cylinder stator and an inner cylinder stator alternately positioned between the outer cylinder rotor and the inner cylinder rotor, and thread grooves engraved on a wall surface of the stator opposed to the rotor, wherein gas rises and falls in an S shape in the up-down direction in the thread groove pump mechanism to be exhausted (see, for example, Japanese Patent No. 3961273 (Patent Literature 1)).

As another vacuum pump, there is known a vacuum pump including a substantially cylindrical casing and a thread groove pump mechanism configured by a substantially cylindrical stator disposed in an axial portion of the casing, a rotor, a rotor shaft of which is supported by the axial portion of the stator to be capable of being driven to rotate, the rotor including a substantially cylindrical cylinder portion between the casing and the stator, ridge portions and thread grooves respectively provided on an inner circumferential surface opposed to a cylinder portion of the casing and an outer circumferential surface opposed to a cylinder portion of the stator, wherein gas is exhausted from up to down in the up-down direction in the thread groove pump mechanism (see, for example, Japanese Utility Model Application Publication No. H5-38389 (Patent Literature 2)).

However, in the former vacuum pump explained above, as shown in FIG. 7, gas near an exhaust side outlet 91*a* of a thread groove 91 of an inner cylinder stator 90 flows into the thread groove 91 forward in a rotating direction R of an inner cylinder rotor 93 climbing over an exhaust side end portion 92*a* of a ridge portion 92 (a flow of the inflow gas is indicated by an arrow A in FIG. 7). Near the exhaust side outlet 91*a* of the thread groove 91 into which the gas flows, a flow of the gas tends to be disturbed to cause retention of the gas.

In an exhaust portion of the thread groove pump mechanism, for example, near an upper end face 90*a* of the inner cylinder stator 90, as indicated by an arrow B in FIG. 8, the gas is sometimes retained while annularly turning along a rotating direction R of the inner cylinder rotor 93 without being sent to an inner circumference side of the inner cylinder stator 90. As indicated by an arrow C in FIG. 8, the gas retained in the exhaust portion flows back to an outer circumference side of the inner cylinder stator 90. Near the exhaust side outlet 91*a* of the thread groove 91 to which the gas flows back, a flow of the gas tends to be disturbed to cause retention of the gas.

In the former and latter vacuum pumps explained above, on a lower end face of the cylinder portion of the rotor, compressed gas is sometimes retained while annularly turning along a rotor rotating direction. The gas retained while turning sometimes flows back upward in the thread groove pump mechanism and disturbs a flow of the gas in the exhaust side outlet of the thread groove. The gas is sometimes retained in the exhaust side outlet of the thread groove.

When the gas is retained in the exhaust side outlet of the thread groove as explained above, the retained gas solidifies under a high pressure, a gas product is deposited, and a channel of the exhaust side outlet of the thread groove is narrowed. Therefore, it is likely that a compression ratio decreases and pump performance is deteriorated.

The discussion above is merely provided for general background information and is not intended to be used as an aid in determining the scope of the claimed subject matter. The claimed subject matter is not limited to implementations that solve any or all disadvantages noted in the background.

SUMMARY OF THE INVENTION

Therefore, there is a technical problem that should be solved to suppress occurrence of the gas product in the exhaust side outlet of the thread groove and maintain the pump performance over a long period. It is an object of the present invention to solve the problem.

The present invention is proposed to attain the object. An embodiment provides a vacuum pump including: a thread groove pump mechanism including a rotor cylinder portion provided in a rotor rotatable in a predetermined rotating direction, a substantially cylindrical stator disposed beside the rotor cylinder portion via a gap coaxially with the rotor cylinder portion; a plurality of ridge portions extended along a gas exhaust direction on either an opposite surface of the stator to the rotor cylinder portion or an opposite surface of the rotor cylinder portion to the stator; and a thread groove engraved between the plurality of ridge portions, the vacuum pump transferring gas in the thread groove from an intake side to an exhaust side in the gas exhaust direction, wherein the vacuum pump includes gas retention suppressing means for suppressing retention of a gas in an exhaust side outlet of the thread groove.

With this configuration, the gas retention suppressing means suppresses the retention of the gas in the exhaust side outlet of the thread groove. Therefore, it is possible to suppress deposit of a gas product due to the retention of the gas in the exhaust side outlet of the gas groove.

An embodiment provides a vacuum pump, wherein, the gas retention suppressing means is an inflow suppressing wall formed by widening an exhaust side end portion of the ridge portion on the exhaust side in the gas exhaust direction greater than an intake side end portion on the intake side in the gas exhaust direction.

With this configuration, since a seal length of the ridge portion increases by the length of the inflow suppressing wall provided in the exhaust side end portion of the ridge portion, the gas in the exhaust side outlet of the thread groove is suppressed from flowing into the thread groove forward in the rotating direction of the rotor climbing over the exhaust side end portion. Therefore, the retention of the gas in the exhaust side outlet of the thread groove is suppressed. It is possible to suppress the deposit of the gas product due to the retention of the gas in the exhaust side outlet of the thread groove.

An embodiment provides a vacuum pump, wherein the inflow suppressing wall is formed in a taper shape gradually widening from the intake side toward the exhaust side along the gas exhaust direction.

With this configuration, since the inflow suppressing wall is formed in the taper shape and the seal length of the ridge portion increases, the gas in the exhaust side outlet of the thread groove is suppressed from flowing into the thread groove forward in the rotating direction of the rotor climbing over the exhaust side end portion of the ridge portion. Since the inflow suppressing wall is formed in a smooth taper shape along the gas exhaust direction, the gas in the thread groove is smoothly exhausted. Therefore, it is possible to further suppress the deposit of the gas product due to the retention of the gas in the exhaust side outlet of the thread groove while suppressing an increase in an outlet pressure of the thread groove.

An embodiment provides a vacuum pump, wherein the ridge portion comprises an equal width region formed in the same width as the intake side end portion and a widened region widened to the exhaust side end portion to be contiguous with the equal width region and forming the inflow suppressing wall.

With this configuration, since the seal length of the ridge portion increases by the length of the inflow suppressing wall formed across the widened region of the ridge portion, the gas in the exhaust side outlet of the thread groove is suppressed from flowing into the thread groove forward in the rotating direction of the rotor climbing over the exhaust side end portion of the ridge portion. Therefore, it is possible to further suppress the deposit of the gas product due to the retention of the gas in the exhaust side outlet of the thread groove.

An embodiment provides a vacuum pump, wherein the gas retention suppressing means is an inflow suppressing blade formed to extend forward in the rotating direction of the rotor from the exhaust side end portion on the exhaust side in the gas exhaust direction of the ridge portion.

With this configuration, since the inflow suppressing blade is extended forward in the rotating direction of the rotor from the exhaust side end portion and the seal length of the ridge portion increases, the gas in the exhaust side outlet of the thread groove is suppressed from flowing into the thread groove forward in the rotating direction of the rotor climbing over the exhaust side end portion of the ridge portion. Since the inflow suppressing blade is locally provided only in the outlet of the thread groove, an excessive decrease in a flow rate of the gas flowing in the screw grove involved in setting of the inflow suppressing blade is avoided. Therefore, it is possible to further suppress the deposit of the gas product due to the retention of the gas in the exhaust side outlet of the thread groove while keeping the flow rate of the gas.

An embodiment provides a vacuum pump, wherein the gas retention suppressing means is a turning retention suppressing wall erected on an exhaust side end face of either the rotor cylinder portion or the stator.

With this configuration, when the gas retained while turning along the rotating direction of the rotor near the exhaust side end face of either the rotor cylinder portion or the stator hits the turning retention suppressing wall and the retention of the gas is attenuated. Therefore, since the gas is suppressed from flowing back into the thread groove from near the exhaust side end face of either the rotor cylinder portion or the stator, the retention of the gas in the exhaust side outlet of the thread groove is suppressed. It is possible to suppress the deposit of the gas product due to the retention of the gas in the exhaust side outlet of the thread groove.

An embodiment provides a vacuum pump, wherein the turning retention suppressing wall comprises a gas guide surface that inclines along the rotating direction of the rotor with respect to a normal direction toward the axis of either the rotor cylinder portion or the stator.

With this configuration, since the gas guide surface of the turning retention suppressing wall guides the gas, which tends to be retained on the exhaust side end face of either the rotor cylinder portion or the stator, toward the axis of either the rotor cylinder portion or the stator, the backflow of the gas retained near the exhaust side end face of either the rotor cylinder portion or the stator into the thread groove is further suppressed. Therefore, it is possible to further suppress the deposit of the gas product due to the retention of the gas in the exhaust side outlet of the thread groove.

An embodiment provides a vacuum pump, wherein the turning retention suppressing wall is formed integrally with the ridge portion.

With this configuration, since the ridge portion is extended from the exhaust side end face of either the rotor cylinder portion or the stator and formed integrally with the turning retention suppressing wall, the gas is suppressed from flowing into the thread groove forward in the rotating direction of the rotor climbing over the exhaust side end portion on the exhaust side in the gas exhaust direction of the ridge portion. Therefore, it is possible to further suppress the deposit of the gas product due to the retention of the gas in the exhaust side outlet of the thread groove.

In the embodiments, since the gas retention suppressing means suppresses the retention of the gas in the exhaust side outlet of the thread groove, it is possible to suppress the deposit of the gas product due to the retention of the gas in the exhaust side outlet of the thread groove.

In some embodiments, since the inflow suppressing wall suppresses the gas in the exhaust side outlet of the thread groove from flowing into the thread groove forward in the rotating direction of the rotor climbing over the exhaust side end portion of the ridge portion, it is possible to suppress the deposit of the gas product due to the retention of the gas in the exhaust side outlet of the thread groove.

In some embodiments, since the inflow suppressing wall suppresses the gas from flowing into the thread groove forward in the rotating direction of the rotor climbing over the exhaust side end portion and the gas in the thread groove is smoothly exhausted along the inflow suppressing wall formed in the taper shape of the ridge portion, it is possible to suppress the deposit of the gas product due to the retention of the gas on the exhaust side of the thread groove while suppressing an increase in an outlet pressure of the thread groove.

In some embodiments, since the inflow suppressing wall formed across the widened region suppresses the gas in the exhaust side outlet of the thread groove from flowing into the gas groove forward in the rotating direction of the rotor climbing over the exhaust side end portion of the ridge portion, it is possible to suppress the deposit of the gas product due to the retention of the gas in the exhaust side outlet of the thread groove.

In some embodiments, since the inflow suppressing wall suppresses the gas from flowing into the thread groove forward in the rotating direction of the rotor climbing over the exhaust side end portion of the ridge portion and an excessive decrease in a flow rate of the gas flowing in the thread groove involved in setting of the inflow suppressing wall is avoided, it is possible to suppress the deposit of the gas product due to the retention of the gas on the exhaust side of the thread groove while keeping the flow rate of the gas.

In some embodiments, since the turning retention suppressing wall attenuates the retention of the gas and suppresses the gas from flowing back to the thread groove, it is possible to suppress the deposit of the gas product due to the retention of the gas in the exhaust side outlet of the thread groove.

In some embodiments, since the gas guide surface guides the gas, which tends to be retained on the exhaust side end face of either the rotor cylinder portion or the stator, from the outer circumference side to the inner circumference side, it is possible to suppress the gas from flowing back into the thread groove from the exhaust side end face of either the rotor cylinder portion or the stator and being retained in the exhaust side outlet of the thread groove and suppress the deposit of the gas product due to the retention of the gas in the exhaust side outlet of the thread groove.

In some embodiments, since the gas is suppressed from flowing into the gas groove forward in the rotating direction of the rotor climbing over the exhaust side end portion of the ridge portion, it is possible to further suppress the deposit of the gas product due to the retention of the gas in the exhaust side outlet of the thread groove.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF THE DRAWINGS

FIGS. 3A and 3B are diagrams of an inner circumference side stator shown in FIG. 1, wherein FIG. 3A is a plan view and FIG. 3B is a side view;

FIGS. 4A and 4B are diagrams showing a modification of the inner circumference side stator shown in FIGS. 3A and 3B, wherein FIG. 4A is a plan view and FIG. 4B is a side view;

FIGS. 5A and 5B are diagrams showing an inner circumference side stator applied to a vacuum pump according to a second embodiment of the present invention, wherein FIG. 5A is a plan view and FIG. 5B is a side view;

FIGS. 6A and 6B are diagrams showing a modification of the inner circumference side stator shown in FIGS. 4A and 4B, wherein FIG. 6A is a plan view and FIG. 6B is a side view;

DETAILED DESCRIPTION

In order to attain an object of suppressing occurrence of a gas product in an exhaust side outlet of a thread groove and maintain pump performance over a long period, the present invention is realized by a vacuum pump including a thread groove pump mechanism including a rotor cylinder portion provided in a rotor rotatable in a predetermined rotating direction, substantially cylindrical two stators disposed respectively on an inner circumferential surface and an outer circumferential surface of the rotor cylinder portion via gaps coaxially with the rotor cylinder portion, and a plurality of ridge portions extended along a gas exhaust direction on either opposite surfaces of the two stators to the rotor cylinder portion, or one of the inner circumferential surface and the outer circumferential surface of the rotor cylinder portion and a thread groove engraved between the plurality of ridge portions, the vacuum pump transferring gas in the thread groove from an intake side to an exhaust side in the gas exhaust direction, wherein the vacuum pump includes gas retention suppressing means for suppressing retention of the gas in an exhaust side outlet of the thread groove.

EMBODIMENTS

Figure 1:
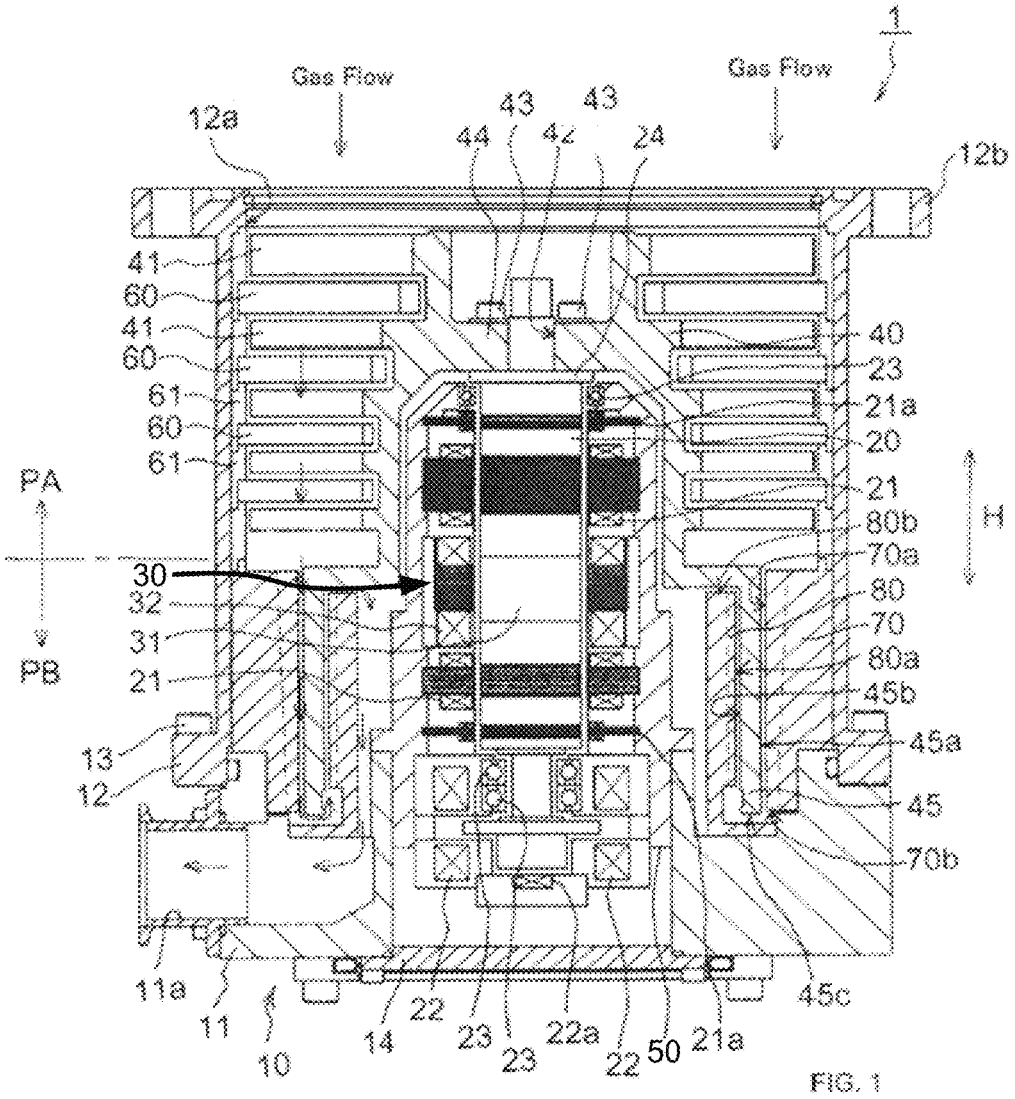
FIG. 1 is a sectional view showing a vacuum pump according to a first embodiment of the present invention.

A vacuum pump according to a first embodiment of the present invention is explained with reference to FIGS. 1 to 3.

The vacuum pump 1 is a compound pump including a turbo molecular pump mechanism PA and a thread groove pump mechanism PB housed in a substantially cylindrical casing 10.

The vacuum pump 1 includes the substantially cylindrical casing 10, a rotor shaft 20 rotatably supported in the casing 10, a driving motor 30 that rotates the rotor shaft 20, a rotating body 40 fixed to an upper part of the rotor shaft 20 and including rotary blades 41 provided in parallel concentrically with respect to the axis of the rotor shaft 20, and a stator column 50 that houses a part of the rotor shaft 20 and the driving motor 30.

The casing 10 is formed in a bottomed cylindrical shape. The casing 10 is configured by a base 11, in a lower part side of which a gas outlet port 11*a* is formed, and a cylinder portion 12, in an upper part of which a gas inlet port 12*a* is formed, the cylinder portion 12 being fixed via bolts 13 in a state in which the cylinder portion 12 is placed on the base 11. Note that reference numeral 14 in FIG. 1 denotes a back lid.

The casing 10 is attached to a not-shown vacuum container such as a chamber via a flange 12*b* of the cylinder portion 12. The gas inlet port 12*a* is connected to the vacuum container. The gas outlet port 11*a* is connected to communicate with a not-shown auxiliary pump.

The rotor shaft 20 is supported by a radial electromagnet 21 and an axial electromagnet 22 in a noncontact manner. The radial electromagnet 21 and the axial electromagnet 22 are connected to a not-shown control unit.

The control unit controls energization currents for the radial electromagnet 21 and the axial electromagnet 22 on the basis of detection values of a radial direction displacement sensor 21*a* and an axial direction displacement sensor 22*a*. Consequently, the rotor shaft 20 is supported in a state in which the rotor shaft 20 floats in a predetermined position.

An upper part and a lower part of the rotor shaft 20 are inserted through a touchdown bearing 23. When the rotor shaft 20 becomes uncontrollable, the rotor shaft 20 rotating at high speed comes into contact with the touchdown bearing 23 to prevent damage to the vacuum pump 1.

The driving motor 30 is configured by a rotor 31 attached to the outer circumference of the rotor shaft 20 and a stator 32 disposed to surround the rotor 31. The stator 32 is connected to the not-shown control unit. Rotation of the rotor shaft 20 and the rotating body 40 is controlled by the control unit.

The rotating body 40 is integrally attached to the rotor shaft 20 by inserting bolts 43 through a rotor flange 44 and screwing the bolts 43 in a shaft flange 24 in a state in which an upper part of the rotor shaft 20 is inserted through a boss hole 42.

The lower end portion of the stator column 50 is fixed to the base 11 via a not-shown bolt in a state in which the stator column 50 is placed on the base 11.

The turbo molecular pump mechanism PA disposed in a substantially upper half of the vacuum pump 1 is explained.

The turbo molecular pump mechanism PA is configured by the rotary blades 41 of the rotating body 40 and fixed blades 60 disposed to be spaced apart from the rotary blades 41. The rotary blades 41 and the fixed blades 60 are alternately arrayed in multiple stages along an up-down direction H. In this embodiment, the rotary blades 41 are arrayed in five stages and the fixed blades 60 are arrayed in four stages.

The rotary blades 41 are formed by blades inclined at a predetermined angle and are integrally formed on an upper outer circumferential surface of the rotating body 40. The rotary blades 41 are radially set around the axis of the rotating body 40.

The fixed blades 60 are formed by blades inclined in the opposite direction of the rotary blades 41 and are held in the up-down direction and positioned by spacers 61 stacked and set on an inner wall surface of the cylinder portion 12. The fixed blades 60 are also radially set around the axis of the rotating body 40.

Intervals among the rotary blades 41 and the fixed blades 60 are set to gradually decrease from up to down in the up-down direction H. The lengths of the rotary blades 41 and the fixed blades 60 are set to gradually decrease from up to down in the up-down direction H.

The turbo molecular pump mechanism PA explained above transfers the gas, which is sucked from the gas inlet port 12*a*, from up to down in the up-down direction H according to rotation of the rotary blades 41.

The thread groove pump mechanism PB disposed in a substantially lower half of the vacuum pump 1 is explained.

The thread groove pump mechanism PB includes a rotor cylinder portion 45 extending downward in the up-down direction H from the lower end of the rotating body 40, a substantially cylindrical outer circumference side stator 70 disposed to surround an outer circumferential surface 45*a* of the rotor cylinder portion 45, and a substantially cylindrical inner circumference side stator 80 disposed beside the rotor cylinder portion 45.

The outer circumferential surface 45*a* and the inner circumferential surface 45*b* of the rotor cylinder portion 45 are formed as flat cylinder surfaces. The outer circumferential surface 45*a* of the rotor cylinder portion 45 is opposed to an inner circumferential surface 70*a*, which is an opposite surface to the outer circumferential surface 45*a* of the rotor cylinder portion 45, of the outer circumference side stator 70 via a predetermined gap. The inner circumferential surface 45*b* of the rotor cylinder portion 45 is opposed to an outer circumferential surface 80*a*, which is an opposite surface to the inner circumferential surface 45*b* of the rotor cylinder portion 45, of the inner circumference side stator 80 via a predetermined gap.

The outer circumference side stator 70 is fixed to the base 11 via not-shown bolts. A plurality of ridge portions 71 are extended along a gas exhaust direction D1 on the inner circumferential surface 70*a* of the outer circumference side stator 70. Thread grooves 72 are engraved among the ridge portions 71. The inner diameter in the thread grooves 72 of the outer circumference side stator 70 is set such that an exhaust side of the gas is narrower than an intake side of the gas.

The inner circumference side stator 80 is fixed to the base 11 via not-shown bolts. A plurality of ridge portions 81 are extended along a gas exhaust direction D2 on the outer circumferential surface 80*a* of the inner circumference side stator 80. Thread grooves 82 are engraved among the ridge portions 81. The outer diameter in the thread grooves 82 of the inner circumference side stator 80 is set such that an exhaust side of the gas is narrower than an intake side of the gas.

The gas transferred downward in the up-down direction H from the gas inlet port 12*a* by the turbo molecular pump mechanism PA is turned back in an S shape in the thread groove pump mechanism PB to be transferred to an outlet port. That is, the rotor cylinder portion 45 rotates at high speed relatively to the outer circumference side stator 70 and the inner circumference side stator 80, whereby the gas is sent downward while being compressed in the thread grooves 72 of the outer circumference side stator 70, turned back upward on the exhaust side end face 45*c* of the rotor cylinder portion 45, sent upward while being further compressed in the thread grooves 82 of the inner circumference side stator 80, turned back downward on an exhaust side end face 80*b* of the inner circumference side stator 80, and exhausted to the outside from the outlet port 11*a* through the inner circumference of the inner circumference side stator 80.

Specific configurations of the ridge portions 71 and the thread grooves 72 of the outer circumference side stator 70 are explained with reference to FIG. 2.

Figure 2:
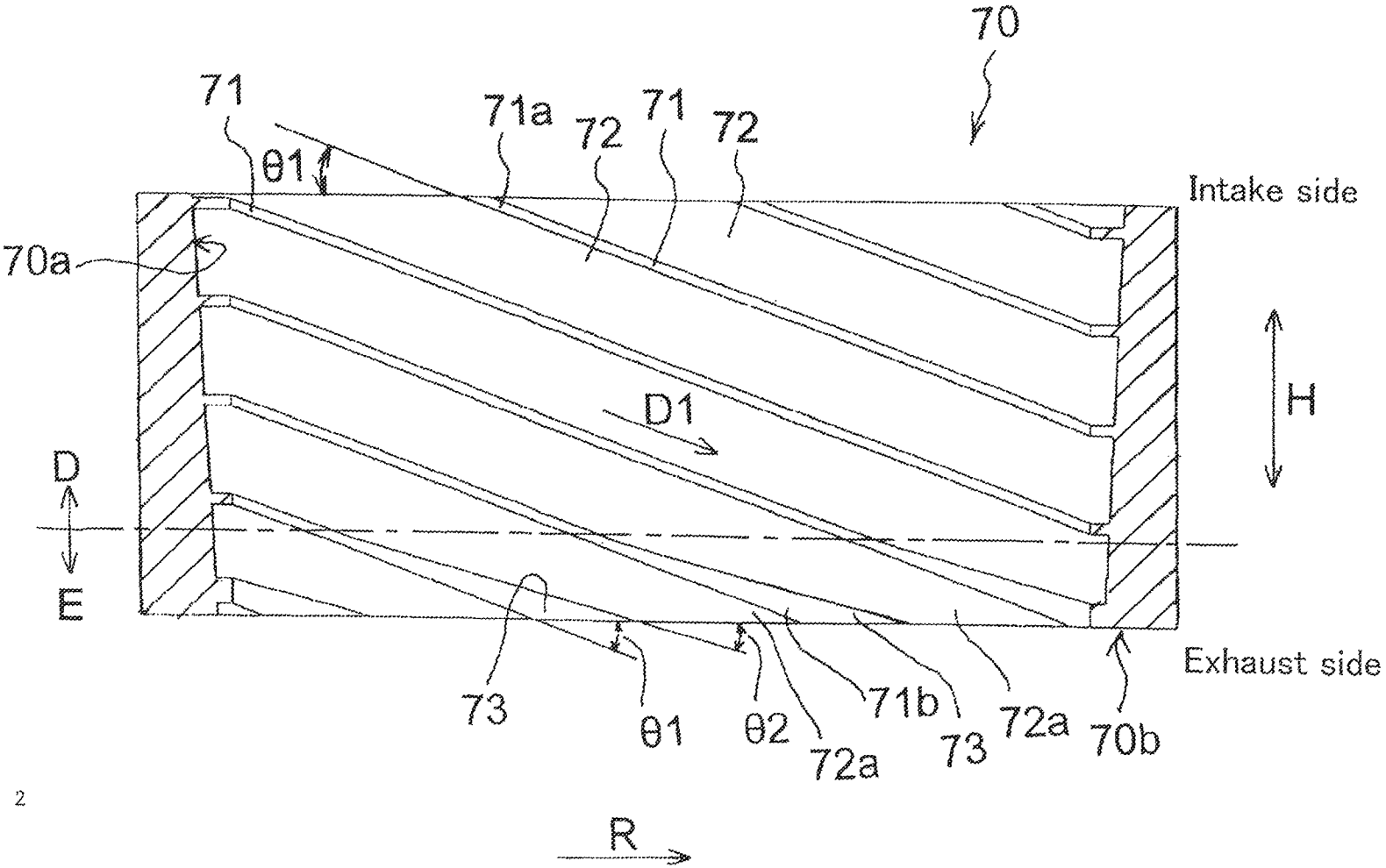
FIG. 2 is a longitudinal direction sectional view of an outer circumference side stator shown in FIG. 1.

As shown in FIG. 2, in an equal width region D extending to a predetermined depth from the intake side in the up-down direction H of the outer circumference side stator 70, the ridge portions 71 are formed in a width dimension substantially the same as the width dimension of intake side end portions 71*a*.

In a widened region E extending to the exhaust side contiguous with the equal width region D, exhaust side end portions 71*b* of the ridge portions 71 are formed wider forward in a rotor rotating direction R. The ridge portions 71 include inflow suppressing walls 73 functioning as gas retention suppressing means for suppressing retention of the gas near exhaust side outlets 72*a* of the thread grooves 72.

A lead angle θ1 of the intake side end portions 71*a* is set to 20°. A lead angle θ2 of the inflow suppressing walls 73 is set to 15°. Note that the lead angle θ2 may be adjusted as appropriate according to components, a flow rate, and the like of exhausted gas.

The inflow suppressing walls 73 may be formed wider backward in the rotor rotating direction R from the exhaust side end portions 71*b* or may be formed wider forward and backward in the rotor rotating direction R from the exhaust side end portions 71*b*.

The inflow suppressing walls 73 are formed in a taper shape to be gradually widened from the intake side to the exhaust side in the gas exhaust direction D1 in the widened region E.

Consequently, a seal length of the inflow suppressing walls 73 is set larger than a seal length of the intake side end portions 71*a*. Since the gas in the thread grooves 72 is smoothly transferred along the taper-shaped ridge portions 71, an increase in an outlet pressure of the thread grooves 72 is suppressed.

Specific configurations of the ridge portions 81 and the thread grooves 82 of the inner circumference side stator 80 are explained with reference to FIGS. 3A and 3B.

Figure 3A:
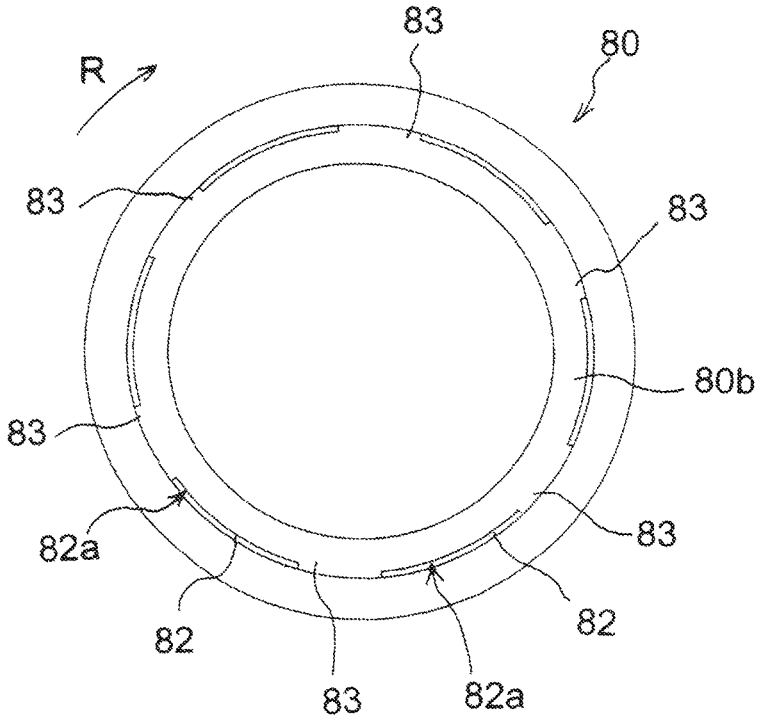
Figure 3B:
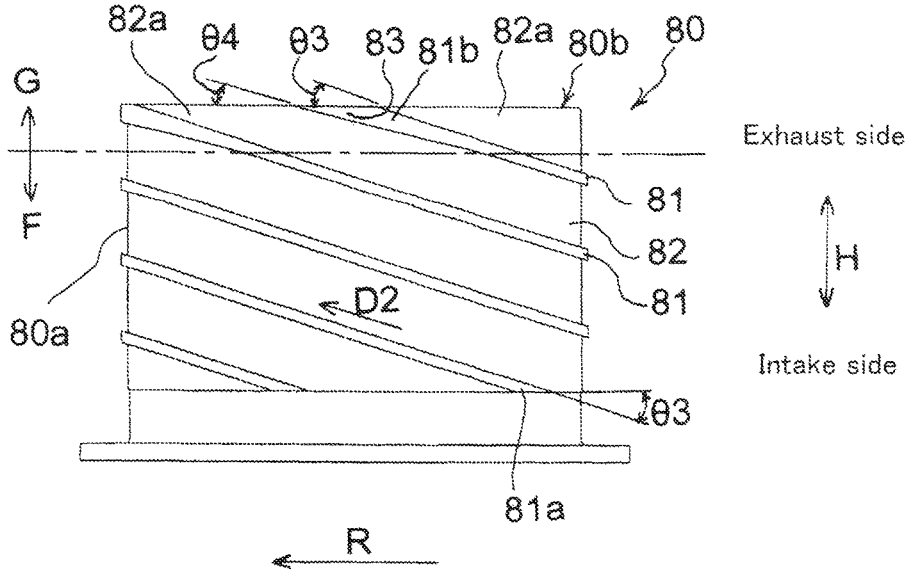

As shown in FIGS. 3A and 3B, in an equal width region F extending to a predetermined depth from the intake side in the up-down direction H of the inner circumference side stator 80, the ridge portions 81 are formed in a width dimension substantially the same as the width dimension of intake side end portions 81*a*.

In a widened region G extending to the exhaust side contiguous with the equal width region F, exhaust side end portions 81*b* of the ridge portions 81 are formed wider forward in the rotor rotating direction R. The ridge portions 81 include inflow suppressing walls 83 functioning as gas retention suppressing means for suppressing retention of the gas near exhaust side outlets 82*a* of the thread grooves 82.

A lead angle θ3 of the intake side end portions 81*a* is set to 20°. A lead angle θ4 of the inflow suppressing walls 83 is set to 15°. Note that the lead angle θ4 may be adjusted as appropriate according to components, a flow rate, and the like of exhausted gas.

The inflow suppressing walls 83 may be formed wider backward in the rotor rotating direction R from the exhaust side end portions 81*b* or may be formed wider forward and backward in the rotor rotating direction R from the exhaust side end portions 81*b*.

The inflow suppressing walls 83 are formed in a taper shape to be gradually widened from the intake side to the exhaust side in the gas exhaust direction D2 in the widened region G.

Consequently, a seal length of the inflow suppressing walls 83 is set larger than a seal length of the intake side end portions 81*a*. Since the gas in the thread grooves 82 is smoothly transferred along the taper-shaped ridge portions 81, an increase in an outlet pressure of the thread grooves 82 is suppressed.

In this way, in the vacuum pump 1, the inflow suppressing walls 73 suppress the gas from flowing into the thread grooves 72 forward in the rotor rotating direction R climbing over the exhaust side end portions 71*b* of the ridge portions 71. Therefore, retention of the gas is suppressed from occurring in the exhaust side outlets 72*a* of the thread grooves 72. It is possible to suppress deposit of a gas product in the exhaust side outlets 72*a* of the thread grooves 72. The inflow suppressing walls 83 suppress the gas from flowing into the thread grooves 82 forward in the rotor rotating direction R climbing over the exhaust side end portions 81*b* of the ridge portions 81. Therefore, retention of the gas is suppressed from occurring in the exhaust side outlets 82*a* of the thread grooves 82. It is possible to suppress deposit of a gas product in the exhaust side outlets 82*a* of the thread grooves 82.

Figure 4A:
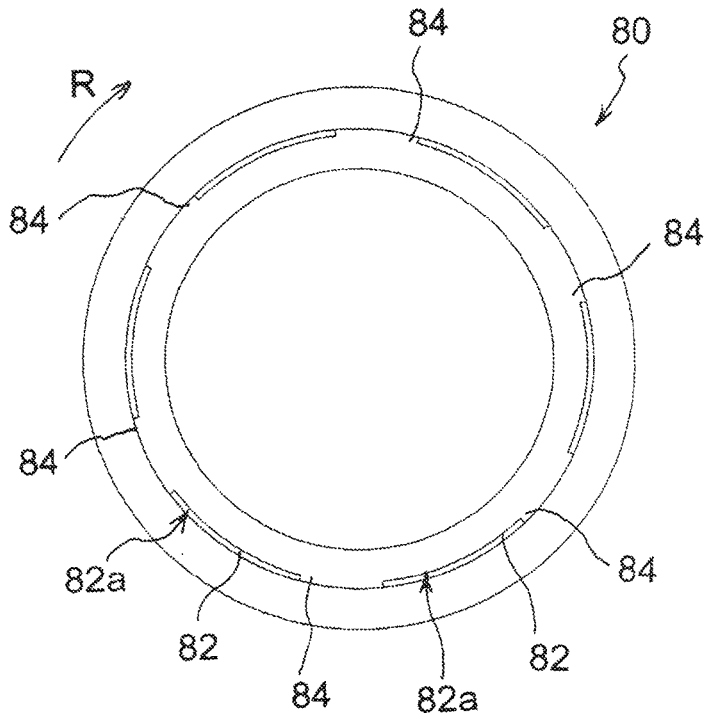
Figure 4B:
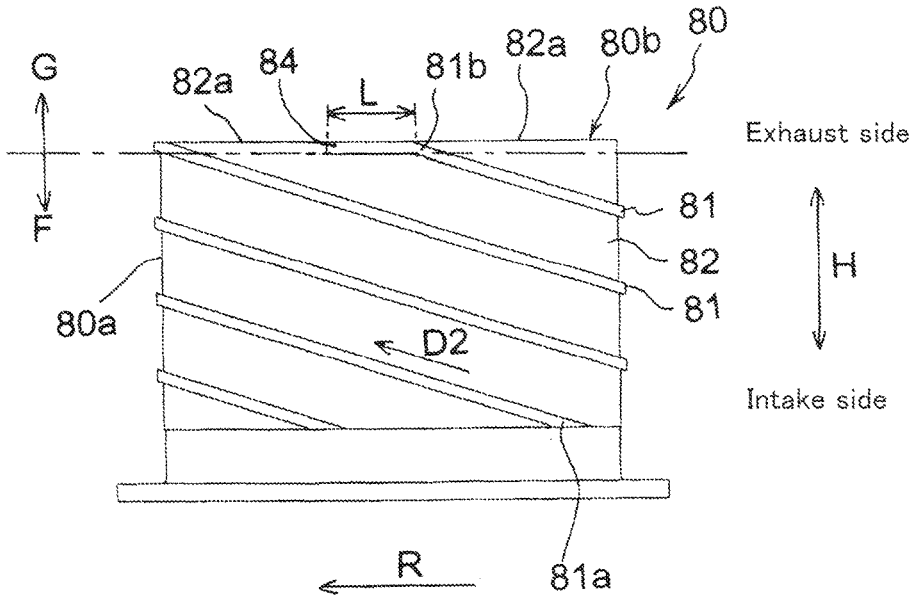

Note that, as shown in FIGS. 4A and 4B, the inflow suppressing walls 83 of the inner circumference side stator 80 may be formed as inflow suppressing blades 84 extended forward in the rotor rotating direction R from the exhaust side end portions 81*b* of the ridge portions 81. Length L along the rotor rotating direction R of the inflow suppressing blades 84 only has to be capable of regulating a flow of the gas about to flow in climbing over the exhaust side end portions 81*b* of the ridge portions 81. The length L is set according to rotor rotating speed and the like.

Consequently, a seal length of the exhaust side end portions 81*b* of the ridge portions 81 is secured longer by the length of the extension of the inflow suppressing blades 84 forward in the rotating direction R from the exhaust side end portion 81*b*. Since the inflow suppressing blades 84 are provided only in the exhaust side end portions 81*b*, an excessive decrease in a flow rate of the gas flowing in the thread grooves 82 is avoided.

In this way, in the vacuum pump 1 applied with the inner circumference side stator 80, the inflow suppressing blades 84 suppress, while securing a flow rate of the gas flowing in the thread grooves 82, the gas near the exhaust side outlets 82*a* of the thread grooves 82 from flowing into the thread grooves 82 forward in the rotor rotating direction R climbing over the exhaust side end portions 81*b* of the ridge portions 81. Therefore, it is possible to suppress deposit of a gas product due to retention of the gas in the exhaust side outlets 82*a* of the thread grooves 82.

Note that, in the outer circumference side stator 70, similarly, inflow suppressing blades may be extended forward in the rotor rotating direction R from the exhaust side end portions 71*b* of the ridge portions 71.

The inner circumference side stator 80 applied to a vacuum pump according to a second embodiment of the present invention is explained with reference to FIGS. 5A and 5B. The vacuum pump according to the first embodiment and the vacuum pump according to this embodiment are only different in specific configurations of the outer circumference side stator 70 and the inner circumference side stator 80. The same members are denoted by the same reference numerals and signs and redundant explanation of the members is omitted. The outer circumference side stator 70 and the inner circumference side stator 80 have the same configuration. Therefore, the specific configuration of the inner circumference side stator 80 is explained below. Explanation concerning the outer circumference side stator 70 is omitted.

Figure 5A:
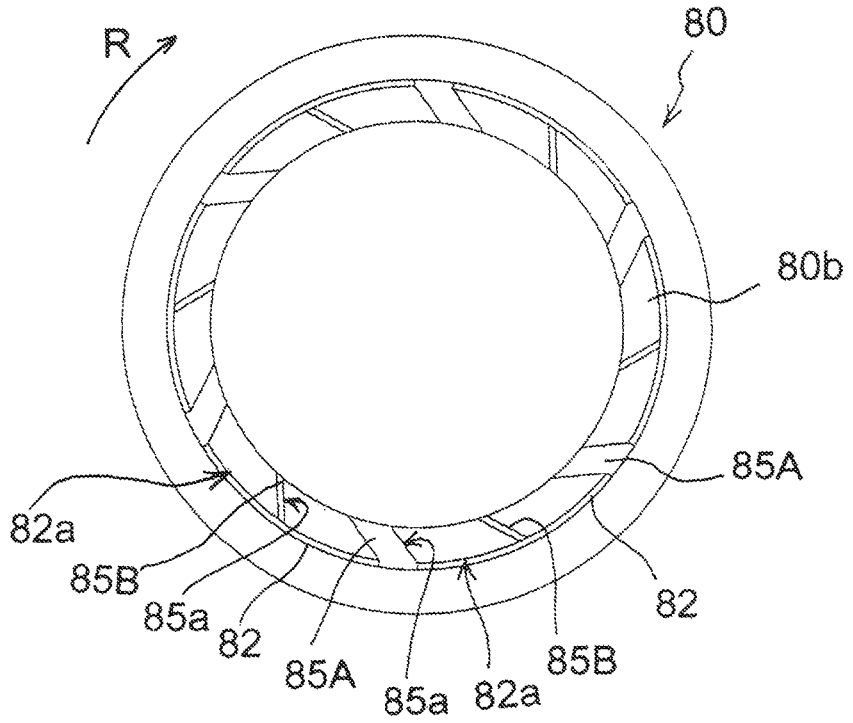
Figure 5B:
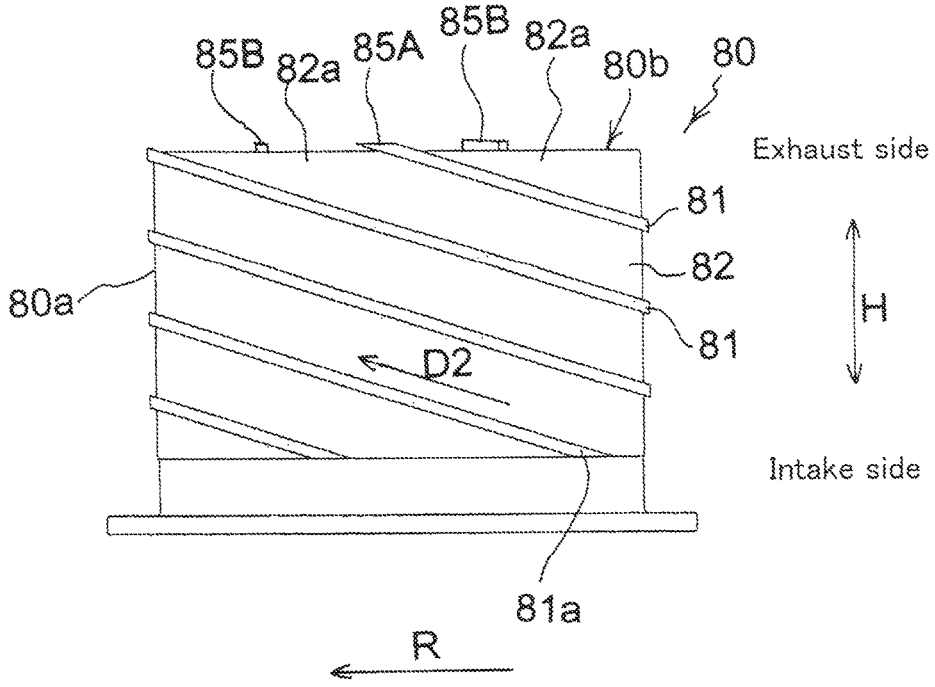

The inner circumference side stator 80 in this embodiment includes, as shown in FIGS. 5A and 5B, turning retention suppressing walls 85 functioning as gas retention suppressing means erected from the exhaust side end face 80*b* to suppress retention of the gas in the exhaust side outlets 82*a* of the thread grooves 82.

Consequently, the gas, which tends to be retained near a turning-back region of the gas, that is, the exhaust side end face 80*b* of the inner circumference side stator 80, hits the turning retention suppressing walls 85 and the retention of the gas is attenuated. The turning retention suppressing walls 85 suppress the gas retained near the exhaust side end face 80*b* of the inner circumference side stator 80 from flowing back to the thread grooves 82.

The turning retention suppressing walls 85 include wide turning retention suppressing walls 85A and narrow turning retention suppressing walls 85B. The wide turning retention suppressing walls 85A and the narrow turning retention suppressing walls 85B are alternately disposed in the rotor rotating direction R. In the following explanation, when the wide turning retention suppressing walls 85A and the narrow turning retention suppressing walls 85B are distinguished, numbers added with A and B at the ends thereof are used as reference signs. When the wide turning retention suppressing walls 85A and the narrow turning retention suppressing walls 85B are collectively referred to, only the numbers are used as reference signs.

The turning retention suppressing walls 85 include gas guide surfaces 85*a* inclined from the outer circumference side toward the inner circumference side of the inner circumference side stator 80.

Consequently, the gas guide surfaces 85*a* guide the gas, which tends to be retained on the exhaust side end face 80*b* of the inner circumference side stator 80, from the outer circumference side to the inner circumference side to further suppress the gas retained near the exhaust side end face 80*b* of the inner circumference side stator 80 from flowing back to the thread grooves 82.

Further, the turning retention suppressing walls 85A are formed integrally with the ridge portions 81.

Consequently, the ridge portions 81 are extended further than the exhaust side end face 80*b* of the inner circumference side stator 80 to suppress the gas from flowing into the thread grooves 82 forward in the rotator rotating direction R climbing over the exhaust side end portions 81*b*.

Figure 6A:
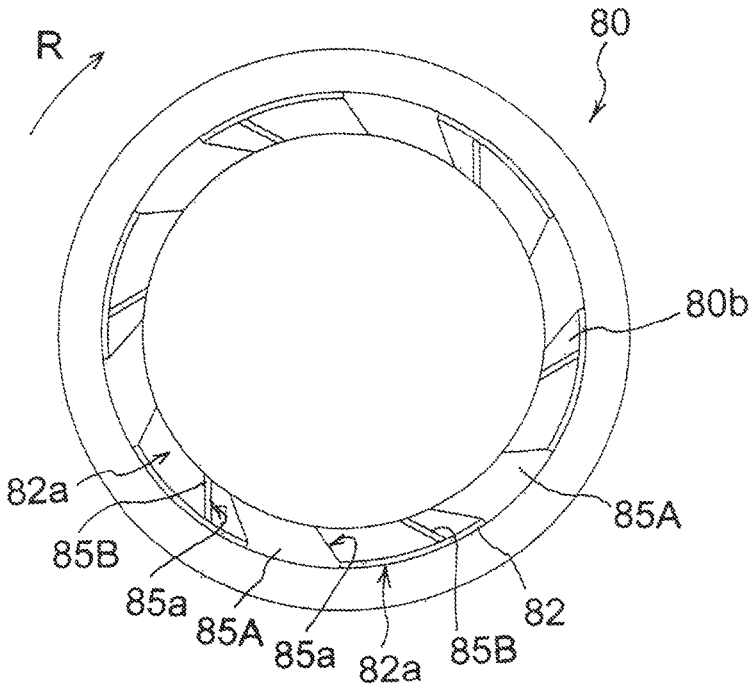
Figure 6B:
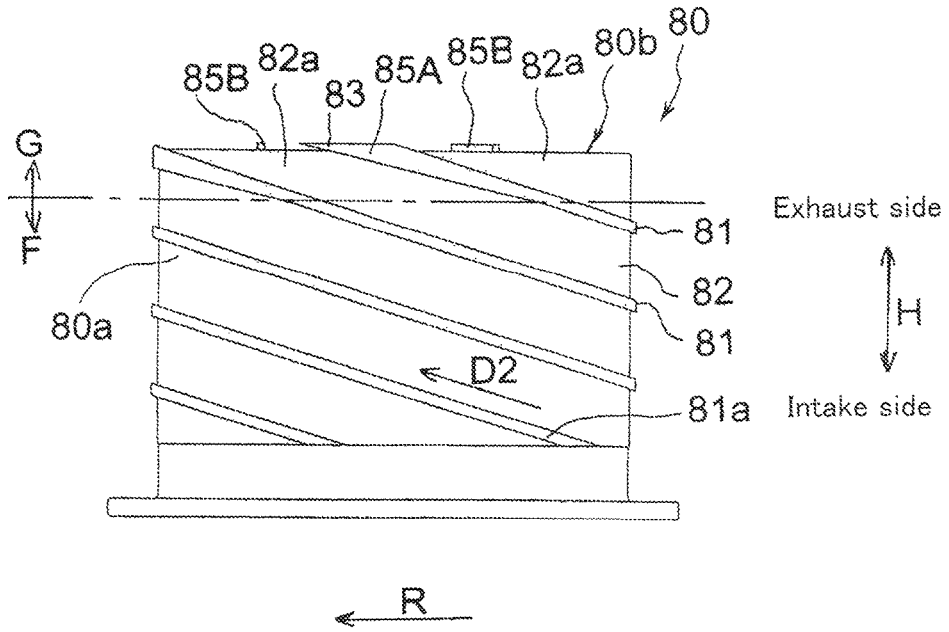
Figure 7:
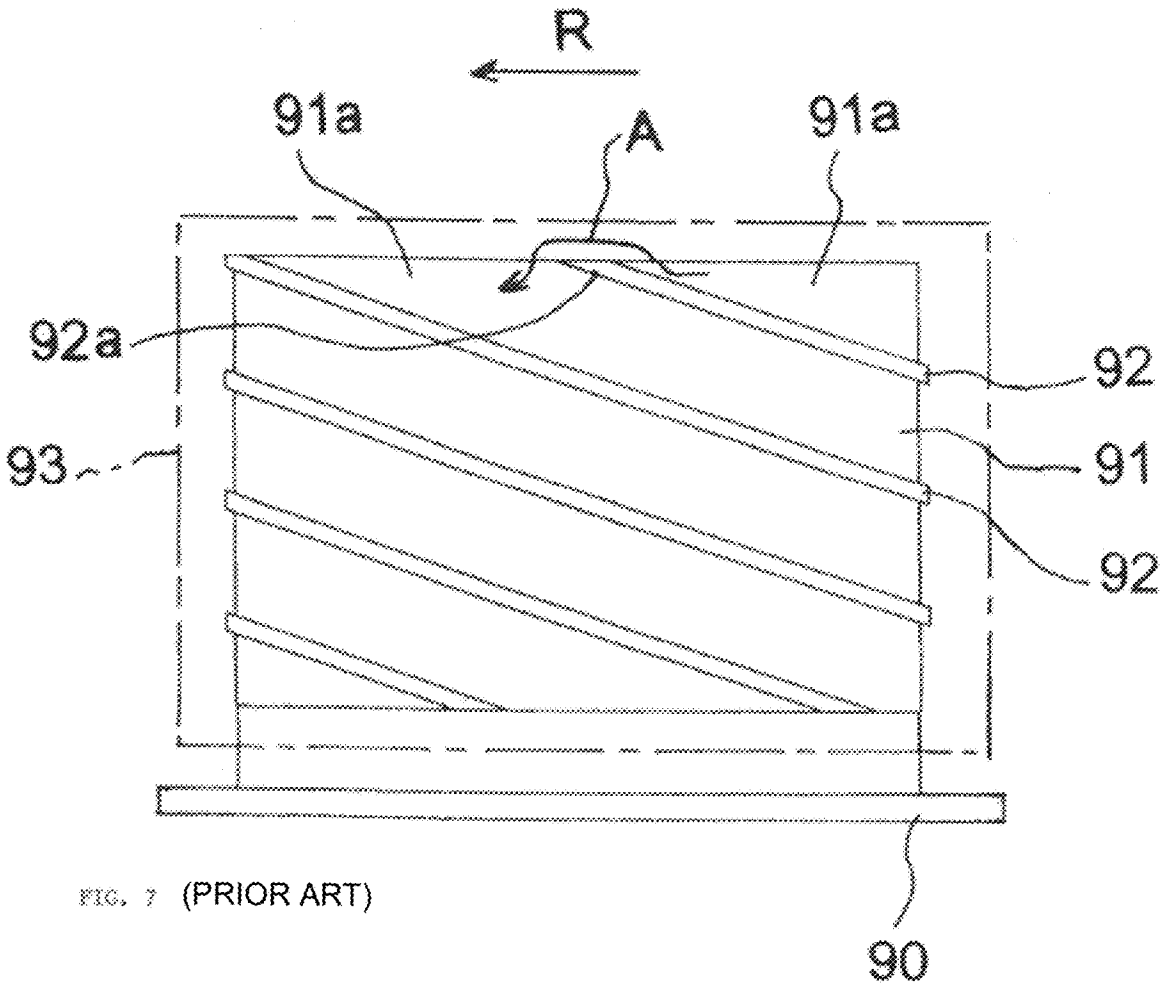
FIG. 7 (PRIOR ART)
FIG. 7 is a side view showing an inner cylinder stator applied to a conventional vacuum pump.
Figure 8:
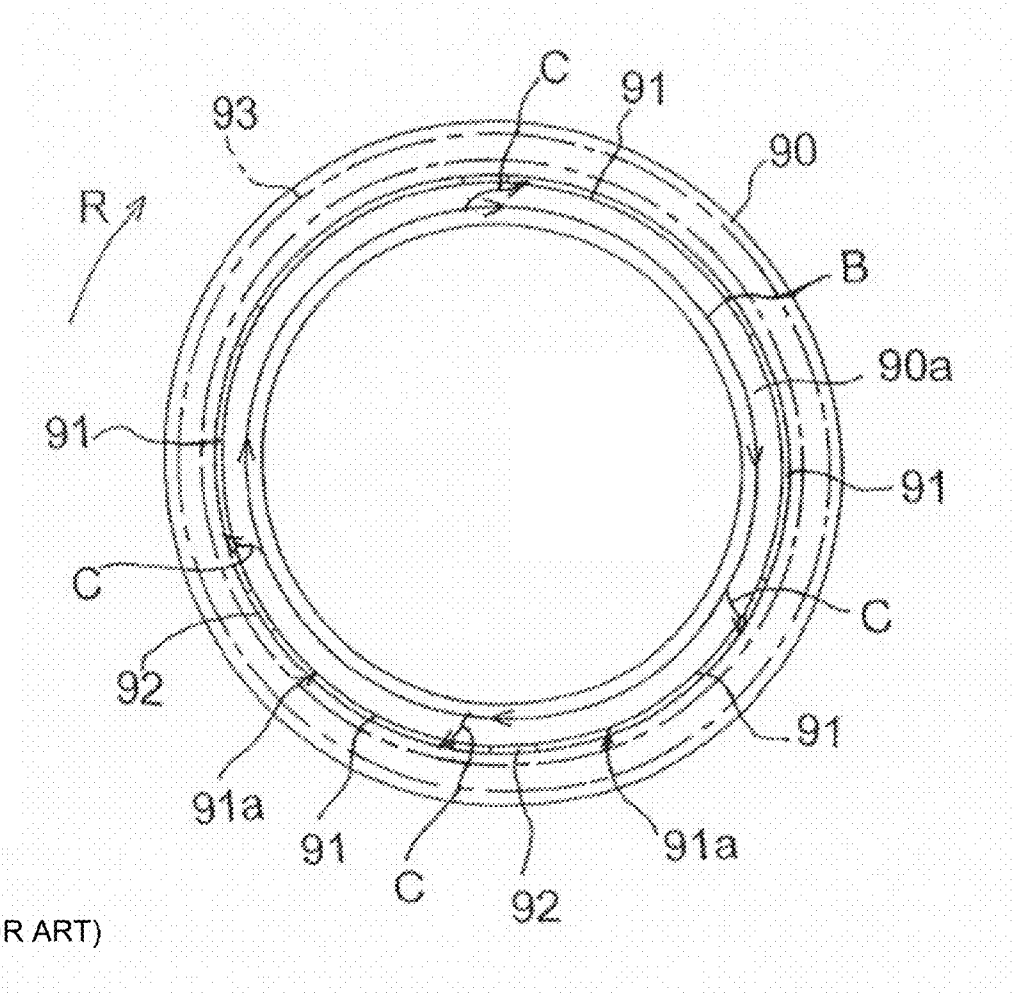
FIG. 8 (PRIOR ART)
FIG. 8 is a plan view of the inner cylinder stator shown in FIG. 7.

As shown in FIGS. 6A and 6B, the turning retention suppressing walls 85A may be formed integrally with the ridge portions 81 including the inflow suppressing walls 83 gradually widened in the widened region E from the intake side toward the exhaust side in the gas exhaust direction D2 and formed in a taper shape.

Consequently, a seal length of the ridge portions 81 is increased. The gas is suppressed from flowing into the thread grooves 82 forward in the rotor rotating direction R climbing over the exhaust side end portions 81*b* of the ridge portions 81.

In this way, in the vacuum pump according to this embodiment, the gas, that tends to be retained near the exhaust side end face 80*b* of the inner circumference side stator 80, is suppressed from flowing back into the thread grooves 82 and being retained in the exhaust side outlets 82*a* of the thread grooves 82. Therefore, it is possible to suppress deposit of a gas product due to the retention of the gas in the exhaust side outlets 82*a* of the thread grooves 82.

Note that, in this embodiment, the turning retention suppressing walls 85 provided in the inner circumference side stator 80 are illustrated. However, the turning retention suppressing walls may be provided on an exhaust side end face 70*b* of the outer circumference side stator 70 or may be provided on the exhaust side end face 45*c* of the rotor cylinder portion 45.

In the embodiments explained above, the ridge portions and the thread grooves are respectively provided on the inner circumferential surface of the outer circumference side stator and the outer circumferential surface of the inner circumference side stator. However, the ridge portions and the thread grooves may be respectively provided on the inner circumferential surface and the outer circumferential surface of the rotor cylinder portion.

In the embodiments, the thread groove pump mechanism of the turning-back structure is illustrated. However, the present invention may be applied to a thread groove pump mechanism of a parallel structure in which gas is discharged from up to down in a pump up-down direction in the thread groove pump mechanism and a thread groove pump mechanism in which a stator is disposed only on the outer circumference side of a rotor cylinder portion and gas is exhausted to the outer circumference side of the rotor cylinder portion.

Note that, naturally, various alterations can be made without departing from the spirit of the present invention and the present invention covers the alterations as well.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

What is claimed is:

1. A vacuum pump comprising a thread groove pump mechanism including:

a rotor cylinder portion provided in a rotor rotatable in a predetermined rotating direction;

a substantially cylindrical stator disposed beside the rotor cylinder portion via a gap coaxially with the rotor cylinder portion;

a plurality of ridge portions extended along a gas exhaust direction on either an opposite surface of the substantially cylindrical stator opposed to the rotor cylinder portion or an opposite surface of the rotor cylinder portion opposed to the substantially cylindrical stator; and a thread groove engraved between the plurality of ridge portions, the vacuum pump transferring gas in the thread groove from an intake side to an exhaust side in the gas exhaust direction, wherein the vacuum pump includes gas retention suppressing means for suppressing retention of a gas in an exhaust side outlet of the thread groove, wherein the gas retention suppressing means is an inflow suppressing wall formed by widening an exhaust side end portion of the plurality of ridge portions on the exhaust side in the gas exhaust direction greater than an intake side end portion of the plurality of ridge portions on the intake side in the gas exhaust direction, and the plurality of ridge portions comprises an equal width region formed in a same width as the intake side end portion and a widening region that begins to widen at an end of the equal width region and widens further between the end of the equal width region and the exhaust side end portion to form the inflow suppressing wall.

2. The vacuum pump according to claim 1, wherein the inflow suppressing wall is formed in a taper shape gradually widening from the intake side toward the exhaust side along the gas exhaust direction.

3. A vacuum pump comprising a thread groove pump mechanism including:

a rotor cylinder portion provided in a rotor rotatable in a predetermined rotating direction;

a substantially cylindrical stator disposed beside the rotor cylinder portion via a gap coaxially with the rotor cylinder portion;

a plurality of ridge portions extended along a gas exhaust direction on either an opposite surface of the substantially cylindrical stator opposed to the rotor cylinder portion or an opposite surface of the rotor cylinder portion opposed to the substantially cylindrical stator;

a thread groove engraved between the plurality of ridge portions, the vacuum pump transferring gas in the thread groove from an intake side to an exhaust side in the gas exhaust direction; and the vacuum pump includes gas retention suppressing means for suppressing retention of a gas in an exhaust side outlet of the thread groove, wherein the gas retention suppressing means is an inflow suppressing blade formed to extend forward in the predetermined rotating direction of the rotor from an exhaust side end portion on the exhaust side in the gas exhaust direction of the plurality of ridge portions.

4. A vacuum pump comprising a thread groove pump mechanism including:

a rotor cylinder portion provided in a rotor rotatable in a predetermined rotating direction;

a substantially cylindrical stator disposed beside the rotor cylinder portion via a gap coaxially with the rotor cylinder portion;

a plurality of ridge portions extended along a gas exhaust direction on either an opposite surface of the substantially cylindrical stator opposed to the rotor cylinder portion or an opposite surface of the rotor cylinder portion opposed to the substantially cylindrical stator;

a thread groove engraved between the plurality of ridge portions, the vacuum pump transferring gas in the thread groove from an intake side to an exhaust side in the gas exhaust direction; and the vacuum pump includes gas retention suppressing means for suppressing retention of a gas in an exhaust side outlet of the thread groove, wherein the gas retention suppressing means is a turning retention suppressing wall erected on an exhaust side end face of either the rotor cylinder portion or the substantially cylindrical stator.

5. The vacuum pump according to claim 4, wherein the turning retention suppressing wall comprises a gas guide surface that inclines along the predetermined rotating direction of the rotor with respect to a normal direction toward an axis of either the rotor cylinder portion or the substantially cylindrical stator.

6. The vacuum pump according to claim 4, wherein the turning retention suppressing wall is formed integrally with the plurality of ridge portions.

7. The vacuum pump according to claim 5, wherein the turning retention suppressing wall is formed integrally with the plurality of ridge portions.

* * * * *